United States Patent [19]

Vuletic

[11] Patent Number: 4,850,574

[45] Date of Patent: Jul. 25, 1989

[54] APPARATUS FOR COOLING AND CLEANING PRODUCER GAS AND TOP GAS

[75] Inventor: Bogdan Vuletic, Düsseldorf, Fed. Rep. of Germany

[73] Assignees: Korf Engineering GmbH, Dusseldorf, Fed. Rep. of Germany; Voest-Alpine Aktiengesellschaft, Linz, Austria

[21] Appl. No.: 252,184

[22] Filed: Sep. 30, 1988

Related U.S. Application Data

[62] Division of Ser. No. 881,071, Jul. 2, 1986, Pat. No. 4,793,857.

[30] Foreign Application Priority Data

Jul. 2, 1985 [DE] Fed. Rep. of Germany ..... 3524011

[51] Int. Cl.[4] ..... F27B 17/00

[52] U.S. Cl. ..... 266/146; 266/156; 266/157; 266/160

[58] Field of Search ..... 75/38; 266/146, 147, 266/156, 157, 160

[56] References Cited

U.S. PATENT DOCUMENTS 4,316,739 2/1982 Beggs et al. ..... 75/38

4,699,655 10/1987 Milionis ..... 266/160

*Primary Examiner*—Melvyn J. Andrews

[57] ABSTRACT

An apparatus for producing cooling gas for a producer gas produced in a melt-down gasifier and surplus gas usable in an appropriate manner by cooling and cleaning at least part of the producer gas and the top gas of an iron ore reduction unit are proposed. The cooling gas is exclusively obtained by preparing producer gas. There is a cooling and a cleaning unit for the surplus gas and the cooling gas in each case. A constant gas flow is passed through the rear portion of the cooling and cleaning unit for the cooling gas with the aid of a constant volume blower. That part of the producer gas supplied to the cooling and cleaning unit for the cooling gas which exceeds this constant gas flow is passed into the cooling and cleaning unit for the surplus gas. The cooling and cleaning units can be constructed in two-stage manner, namely with in each case one packing washer (3 or 6) and a following adjustable Venturi washer (5 or 8).

13 Claims, 1 Drawing Sheet

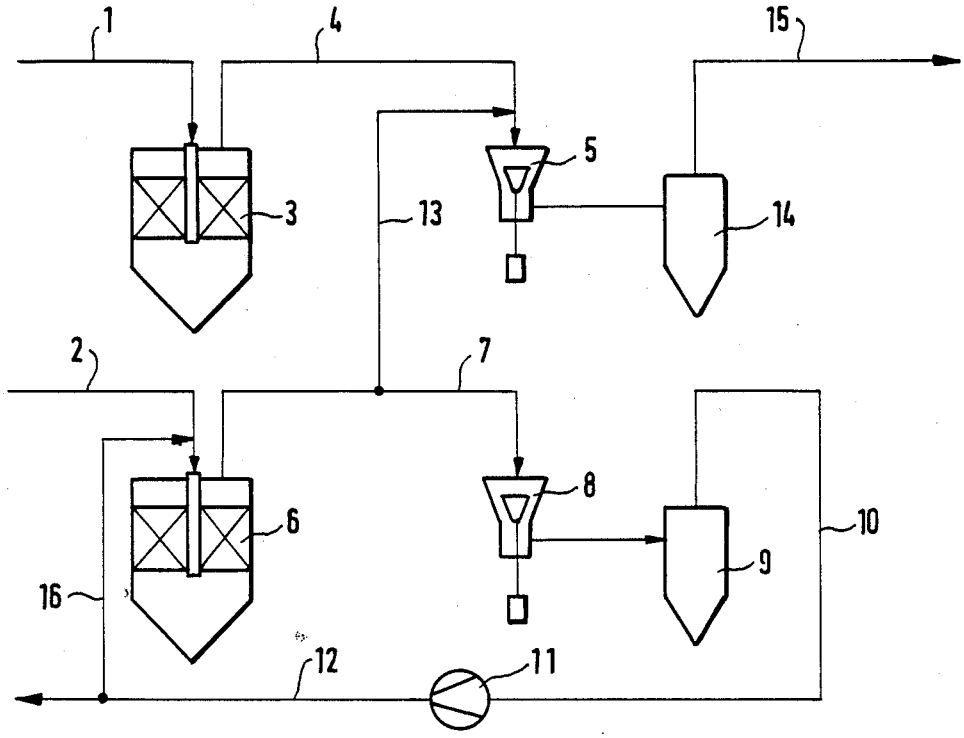
1
4
15
5
3
13
14
2
7
8
6
10
9
16
12
11

APPARATUS FOR COOLING AND CLEANING PRODUCER GAS AND TOP GAS

This is a division of application Ser. No. 881,071, filed July 2, 1986, now U.S. Pat. No. 4,793,857.

BACKGROUND OF THE INVENTION

The invention relates to a process for producing cooling gas for a producer gas produced in a melt-down gasifier and surplus gas usable in an appropriate manner by cooling and cleaning at least part of the producer gas and the top gas of an iron ore reduction unit, the cooling gas being obtained exclusively from the producer gas.

German Pat. No. 30 34 539 discloses a process for directly producing molten pig iron from lump iron ore, which is reduced in a direct reduction shaft furnace to sponge iron by means of reducing gas and is then melted in a melt-down gasifier with the aid of coal and oxygen-containing gas and simultaneously the producer gas used for reducing the iron ore is produced. This is cooled and the dust removed threefrom and then a first partial flow thereof is blown into the reducing zone of the direct reduction shaft furnace. A second partial flow is cooled and washed again for producing cooling gas for the producer gas. The top gas obtained in the direct reduction shaft furnace is removed at its upper end and supplied for appropriate uses, it normally being worked up in a cooling and cleaning unit separate from the producer gas circuit. These units are subject to widely varying operating conditions both for the producer gas and for the top gas. In normal operation, almost the entire producer gas produced in the melt-down gasifier is used as reducing gas and also the cooling gas quantity can be very small, so that no or little surplus gas, not required for operational purposes and emanating from the producer gas is obtained. On starting up the apparatus operating according to the known principle, as well as during different operating faults, most of the producer gas is guided via the cooling and cleaning unit for the cooling gas, whereas the top gas quantity is very small. Thus, fluctuations occur with regards to the gas quantities passed through the particular washer up to a ratio of approximately 1:20. However, the control range of the washer used extends over a quantity ratio of up to approximately 1:4. In the case of quantity fluctuations exceeding this ratio, it is therefore not possible to maintain the operation of the apparatus and the admissible clean gas dust contents. A regulation of the quantity changes to approximately 1:20 can possibly be obtained if each cleaning unit was equipped with two adjustable Venturi washers or scrubbers and the associated drop separators. However, this would lead to other difficulties, particularly the risk of frequent obstruction or clogging due to the considerable dust quantities carried in the gases.

The problem of the present invention is therefore to improve the known process for producing cooling gas for producer gas produced in a melt-down gasifier and surplus gas usable in an appropriate manner by cooling and cleaning at least part of the producer gas and the blast furnace gas of an iron ore reduction unit, the cooling gas being obtained exclusively from the producer gas, in such a way that with considerable fluctuations of the gas quantities supplied to the cooling and cleaning units it is always possible to drop the dust content to the desired values of e.g. 5 to 10 mg/Nm$^3$, the maintenance of such units being simple and inexpensive, whilst their energy consumption is also relatively low.

SUMMARY OF THE INVENTION

According to the invention this problem is solved in that separate cooling and cleaning units are used for producing the cooling and surplus gas and that a substantially constant gas quantity is passed at least through the end stage of the cooling and cleaning unit, in such a way that the part of the producer gas to be cooled and cleaned exceeding this gas quantity is passed into the cooling and cleaning unit for the surplus gas.

According to an advantageous development of this process, cleaning takes place in two-stage manner in each of the cooling and cleaning units and the part of the producer gas used for producing the surplus gas is passed through the first cleaning stage of the cooling and cleaning unit for the cooling gas and then through the second cleaning stage of the cooling and cleaning unit for the surplus gas. That part of the gas quantity produced in the melt-down gasifier no longer required in the arrangement comprising the melt-down gasifier and the reduction unit is preferably exclusively removed via the cooling and cleaning unit for the surplus gas and only the gas quantity required as cooling and feed gas in the arrangement comprising the melt-down gasifier and reduction unit is passed through the cooling and cleaning unit for the cooling gas. That part of the gas removed from the cooling and cleaning unit for the cooling gas not required as cooling and feed gas in the arrangement comprising the melt-down gasifier and reduction unit can be returned to the inlet of said unit, so that the gas quantity passed through the latter is substantially constant and independent on the cooling gas requirement.

In an advantageous apparatus for performing the inventive process, each cooling and cleaning unit has a packing washer and an adjustable Venturi washer following the same. There is preferably a connecting line from the outlet of the packing washer of the cooling and cleaning unit for the cooling gas to the inlet of the Venturi washer of the cooling and cleaning unit for the surplus gas. A particularly appropriate apparatus is characterized in that a feed or conveyor means with a constant flow quantity is arranged in the cooling and cleaning unit for the cooling gas behind the branch for the connecting line or behind said unit.

BRIEF DESCRIPTION OF THE DRAWING

The invention is described in greater detail hereinafter relative to an embodiment shown in the drawing, which diagrammatically represents the cooling and cleaning units for the producer gas and the top gas of an arrangement comprising a direct reduction unit and a melt-down gasifier.

DETAILED DESCRIPTION OF A PREFERRED EMBODIMENT

Via line 1 the units are supplied with the top gas from a direct reduction shaft furnace and via line 2 with that part of the producer gas produced in a melt-down gasifier which is not blown directly into the reducing zone of the direct reduction shaft furnace. The pressurized top gas passes from line 1 into a packing washer 3, where it is cooled to the desired temperature and undergoes preliminary washing. Thus thus prepared top gas is then passed via a line 4 into an adjustable Venturi washer 5.

The part of the producer gas flowing through line 2 passes into a packing washer 6, in which said gas is also cooled to the desired temperature and undergoes preliminary washing. Part of the thus pretreated gas is led via a line 7 to an adjustable Venturi washer 8, where it is again washed, so that the requisite clean gas dust content is reached. The gas subsequently undergoes dewatering in a following drop separator 9. It then passes via a line 10 to a blower 11, by which it is brought to the necessary pressure so as to be available in a line 12 as cooling gas mainly for adjusting the producer gas temperature.

Blower 11 is a volume conveyor, which always conveys the same gas quantity at a constant plant pressure, so that a constant gas quantity flows through the Venturi washer 8. As the gas quantity supplied via line 2 does not correspond to the gas quantity required by blower 11, the outlet line of the packing washer 6 is branched into line 7 and a further line 13, which leads the gas quantity not taken up by line 7 to the inlet of the Venturi washer 5. To the latter line 4 supplies the top gas prepared in the packing washer 3 and via line 13 part of the producer gas prepared in packing washer 6. The sum of these two gas quantities is also substantially constant in the case of extraordinary operating states. Venturi washer 5 is also followed by a drop separator 14 for dewatering the cleaned gas. Line 15 supplies the cleaned, cooled surplus gas of the plant to appropriate consumption means.

To the extent that the cooling gas in line 12 is not required in the arrangement comprising the melt-down gasifier and direct reduction shaft furnace, it is again supplied to the inlet of packing washer 6 via a branched line 16. This ensures that independently of the cooling gas requirement of the reduction plant, an approximately constant gas quantity always flows through Venturi washer 8.

The two packing washers 3, 6 are relatively insensitive to the considerable fluctuations of the gas quantities passed through. The dust from the gases is substantially removed therefrom, so that the dust quantities washed out in Venturi washers 5, 8 are relatively small and there is no risk of them becoming blocked. Thus, it is possible to receive gases with an extremely low clean gas dust content of 5 mg/Nm$^3$ at the Venturi washer outlet.

The Venturi washer operation is dependent on the gas quantity passed through them. As a result of the described measures, particularly the blower 11 delivering a constant gas volume and the line 13 between the outlet of packing washer 6 and the inlet of the Venturi washer 5, it is ensured that substantially constant gas flows flow through Venturi washers 5, 8. Thus, optimum deposition levels can be achieved on the one hand for Venturi washer 5, in that the part of the gas quantity produced in the melt-down gasifier and not required in the arrangement comprising gasifier and direct reduction shaft furnace is exclusively removed via said Venturi washer as surplus gas, and on the other hand for the Venturi washer 8, in that through the latter is only passed the gas quantity required as cooling and feed gas in the arrangement comprising melt-down gasifier and direct reduction shaft furnace. This ensures that under all operating conditions the clean gas dust content does not exceed the given values. As the Venturi washers only perform the final cleaning of the gases, there is also no need to fear them becoming blocked with excessive dust quantities. Thus, the apparatus not only leads to excellent operating results, but also operates in a substantially maintanence and trouble-free manner.

I claim:

1. A system for producing a cooling gas for a melt-down gasifier and an iron reduction unit, and for producing a surplus gas for use outside the gasifier and reduction unit, comprising: first means for passing a substantially constant gas quantity of a producer gas from the melt-down gasifier through a gasifier supply conduit having a cooling and cleaning apparatus and back into the melt-down gasifier and reduction unit as a cooling gas; second means for passing a top gas from an iron reduction unit through a surplus gas supply line having a cooling and cleaning apparatus to the outside use; and third means for passing the producer gas exceeding said substantially constant gas quantity directly into the surplus gas supply line through the cooling and cleaning apparatus therein and to the outside use, while by-passing the melt-down gasifier and iron reduction unit.

2. A system according to claim 1, wherein each cooling and cleaning apparatus has a first and a final cleaning stage, said third means passing the producer gas exceeding said constant gas quantity through the first cleaning stage of the cooling and cleaning apparatus in the gasifier supply conduit, and thereafter through the final stage of the cooling and cleaning apparatus in the surplus gas supply line.

3. A system according to claim 1, comprising means for removing water contained in the cooling and surplus gases passed through the cooling and cleaning apparati.

4. A system according to claim 2, comprising means for removing water contained in the cooling and surplus gases passed through the cooling and cleaning apparati.

5. A system according to claim 1, wherein each cooling and cleaning apparatus has a packing washer and an adjustable Venturi washer downstream thereof.

6. A system according to claim 5, comprising a connecting line from an outlet of the packing washer of the cooling and cleaning apparatus in said first conduit menas to an inlet of the Venturi washer in said third conduit means.

7. A system according to claim 5, comprising a drop separator connected to an outlet of each Venturi washer.

8. A system according to claim 6, comprising a crop separator connected to an outlet of each Venturi washer.

9. A system according to claim 6, comprising conveyor means with a constant flow quantity in said first conduit means downstream of the connecting line or of said cooling and cleaning apparatus.

10. A system according to claim 7, comprising conveyor means with a constant flow quantity in said first conduit means downstream of the connecting line or of said cooling and cleaning apparatus.

11. A system according to claim 9, comprising a blower connected to an outlet of the cooling and cleaning apparatus in said first conduit means.

12. A system according to claim 10, comprising a blower connected to an outlet of the cooling and cleaning apparatus in said first conduit means.

13. A system according to claim 12, wherein an outlet of the drop separator of the cooling and cleaning apparatus in said first conduit means is connected via blower to an inlet of the packing washer associated therewith.

* * * * *